US008935858B2

(12) United States Patent
Cloutier et al.

(10) Patent No.: US 8,935,858 B2
(45) Date of Patent: Jan. 20, 2015

(54) ROLLED GARMENT STORAGE

(71) Applicants: Michelle Cloutier, West Bridgewater, MA (US); Tim Cloutier, West Bridgewater, MA (US); Jeff Cloutier, Thornton, CO (US)

(72) Inventors: Michelle Cloutier, West Bridgewater, MA (US); Tim Cloutier, West Bridgewater, MA (US); Jeff Cloutier, Thornton, CO (US)

( * ) Notice: Subject to any disclaimer, the term of this patent is extended or adjusted under 35 U.S.C. 154(b) by 122 days.

(21) Appl. No.: 13/646,832

(22) Filed: Oct. 8, 2012

(65) Prior Publication Data

US 2014/0096408 A1 Apr. 10, 2014

(51) Int. Cl.

| | |
|---|---|
| ***F26B 11/02*** | (2006.01) |
| ***F26B 5/04*** | (2006.01) |
| ***D06F 49/00*** | (2006.01) |
| *D06F 45/00* | (2006.01) |

(52) U.S. Cl.

CPC ..... *F26B 5/045* (2013.01); *D06F 49/00* (2013.01)

USPC ..... 34/105; 68/20; 8/159

(58) Field of Classification Search

CPC ..... F26B 3/00; F26B 5/00; F26B 5/04; F26B 5/042; F26B 5/045; F26B 5/14; F26B 11/00; F26B 11/0413; F26B 13/00; F26B 19/00; F26B 20/00; F26B 25/00; F26B 25/06; D06F 45/00; D06F 49/00; D06F 58/203; D06F 58/04

USPC ..... 34/104, 105; 68/19, 20; 8/149, 159

See application file for complete search history.

(56) References Cited

U.S. PATENT DOCUMENTS

| | | | | |
|---|---|---|---|---|
| 4,545,841 | A * | 10/1985 | Jackrel | 156/290 |
| 4,784,909 | A | 11/1988 | Emi et al. | |
| 4,967,986 | A | 11/1990 | Schildkraut | |
| 5,740,551 | A * | 4/1998 | Walker | 2/16 |
| 5,956,770 | A * | 9/1999 | Dennis | 2/160 |
| 6,274,218 | B1 | 8/2001 | Shimizu | |
| 6,275,995 | B1 * | 8/2001 | Le Gette et al. | 2/160 |
| 7,028,870 | B2 | 4/2006 | Valdez-Campbell | |
| 7,328,523 | B2 * | 2/2008 | Vossoughi et al. | 34/90 |
| 7,340,845 | B2 * | 3/2008 | Kneebone | 34/60 |
| 7,895,768 | B2 * | 3/2011 | Vossoughi et al. | 34/60 |
| 8,186,075 | B2 * | 5/2012 | Beckett | 34/106 |
| 2003/0181118 | A1 | 9/2003 | Ko et al. | |
| 2006/0124477 | A1 | 6/2006 | Cornelius et al. | |
| 2009/0071028 | A1 * | 3/2009 | Gadke et al. | 34/108 |
| 2011/0245790 | A1 | 10/2011 | Castro | |

FOREIGN PATENT DOCUMENTS

JP 62231698 A * 10/1987

* cited by examiner

*Primary Examiner* — Steve M Gravini

(74) *Attorney, Agent, or Firm* — Lambert & Associates; Gary E. Lambert; David J. Connaughton, Jr.

(57) ABSTRACT

A garment drying device is provided. The garment drying device has a flexible outer layer, with a flexible inner layer attached. The outer layer may be substantially planar and may have an inner surface and an outer surface. The inner layer may be substantially planar and formed of an absorbent and flexible material. The device may further have a closure structure capable of holding the device in a rolled position when closed, and allowing the device to be in an unrolled position when open.

20 Claims, 5 Drawing Sheets

ROLLED GARMENT STORAGE

BACKGROUND OF THE INVENTION

1. Field of the Invention

The present invention relates generally to garment storage. More particularly the present invention relates to a device to store wet garments and to absorb moisture from the garments.

2. Description of Related Art

When travelling, transportation of wet or moist garments can be problematic because of the tendency for the garment to wet surrounding materials, and to develop an offensive odor. These garments may be wetted by exercising, swimming, washing, rain, and the like. Solutions developed thus far have included storing the moist garments in a sealed plastic bag, spending the time to dry the items, and isolating the damp garments in a separate luggage compartment. However, all of these solutions either leave the garments wet and likely malodorous, or require excessive time that often is not a luxury during travel.

Therefore, what is needed is a device that may efficiently dry a moist garment while isolating the garment. Further, what is needed is a device that may prevent the development of offensive odors caused by storage of moist garments.

SUMMARY OF THE INVENTION

The subject matter of this application may involve, in some cases, interrelated products, alternative solutions to a particular problem, and/or a plurality of different uses of a single system or article.

In one aspect, a garment drying device is provided. The garment drying device has a flexible outer layer, with a flexible inner layer attached. The outer layer may be substantially planar and may have an inner surface and an outer surface. The inner layer may be substantially planar and formed of an absorbent and flexible material. The device may further have a closure structure capable of holding the device in a rolled position when closed, and allowing the device to be in an unrolled position when open.

In another aspect, a method of drying and storing a moist garment using a drying device is provided. The method begins with placing a moist garment on an absorbent flexible inner layer of the drying device. Next, moisture is urged out of the garment using the drying device by rolling the device into a cylindrical shape and securing it in a rolled position. The device with the garment secured therein is then stored for a time to allow a quantity of moisture to be transferred from the garment to the inner layer.

DETAILED DESCRIPTION

Figure 1:
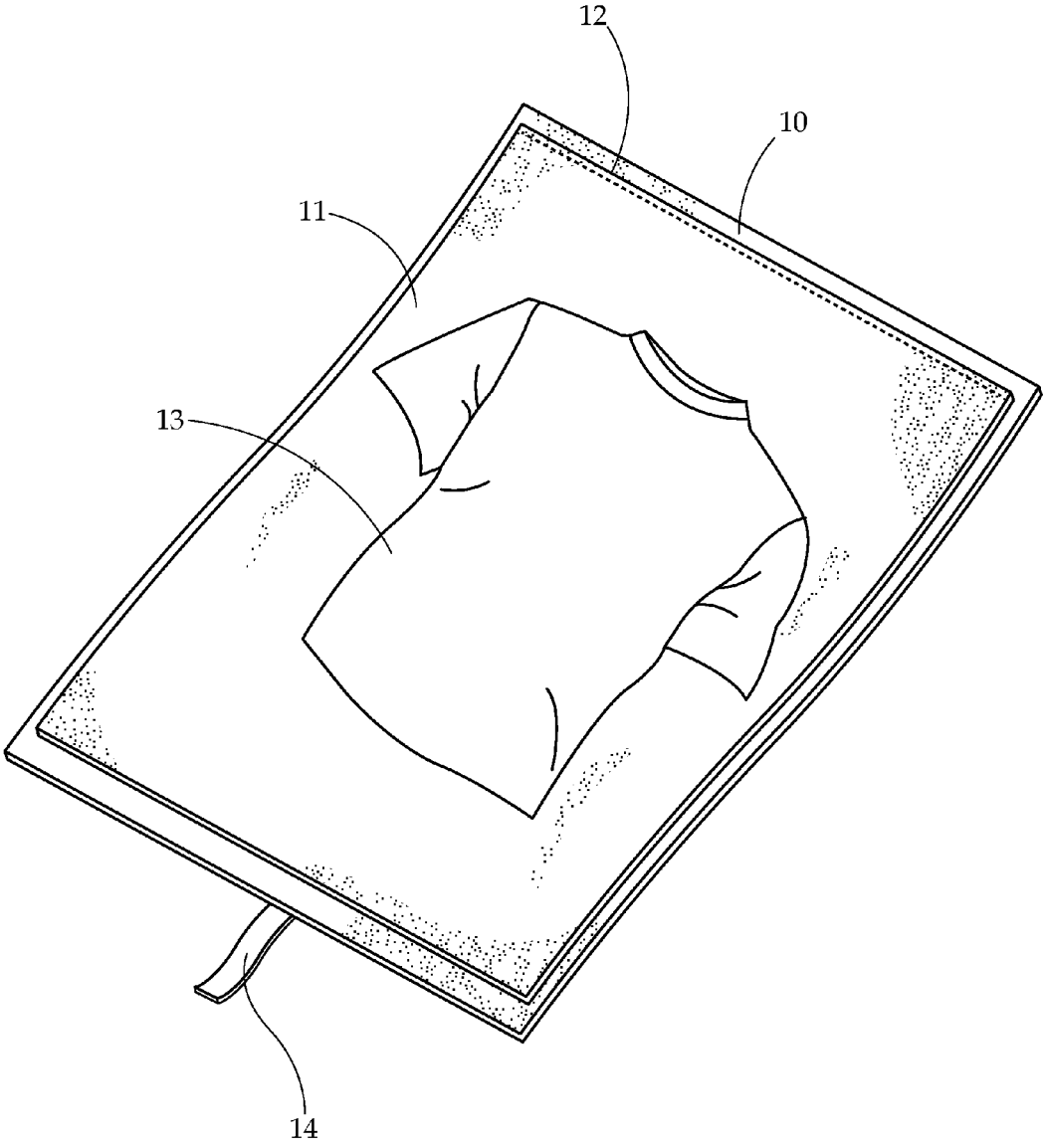
FIG. 1 provides an embodiment of the drying device in an unrolled position.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a device configured to roll about a moist garment. The device may have a rollable outer layer and a rollable inner layer, the inner layer configured to absorb moisture from the moist garment. In operation, the garment may be placed on the inner layer of the device when unrolled, then the device may be rolled over the garment, thereby compressing the garment against the inner layer, and secured in the rolled position, thereby storing the garment and absorbing moisture from the garment. Moreover, the present invention utilizes compression from the rolling to aid in fluid transfer from the garment to the inner layer.

The outer layer may be of any planar shape that may receive a garment. Examples of shapes of the outer layer include by are not limited to rectangular, square, circular oval, and the like.

The outer layer may be made of any material that may be flexible enough for rolling, and durable enough to withstand forces experienced during the rolling and storage. Examples of materials of which the outer layer may be made include, but are not limited to Cordura®, coated nylon, nylon, GoreTex®, cotton, wool, polyester, polypropylene, and the like. In one embodiment, the material of which the outer layer is made may be machine washable. In another embodiment, the outer layer may be substantially water impermeable. In yet another embodiment, the outer layer may be breathable, allowing the passage of air.

In one embodiment, the outer layer may be formed to provide a separation barrier between a moist garment and an exterior of the device. As such, the device may be rolled to store the moist garment and prevent transfer of the moisture therein to an outside of the device.

An inner layer may be attached to an interior of the outer layer. In one embodiment, the inner layer may be formed of an absorbent material to receive and retain excess moisture from the moist garment. In one embodiment, the inner layer may be removably attached to the outer layer. In another embodiment, the inner layer may be permanently attached to the outer layer. In still another embodiment, the inner layer may form a pocket by being attached at two or more places to the outer layer. In embodiments having a removable inner layer, the inner layer may be disposable, and/or may be machine washable.

The inner layer may have a substantially similar shape to the outer layer. In one embodiment, the inner layer is slightly smaller than the outer layer, but having the same approximate shape as the outer layer to allow for effective and uniform rolling of the device.

The inner layer may be made of any material that may be flexible enough for rolling, and durable enough to withstand forces experienced during the rolling and storage. In one embodiment, the inner layer may be made of a substantially absorbent material. In still another embodiment, the inner layer maybe be formed of a substantially water permeable membrane. Materials of which the inner layer may be made include, but are not limited to chamois, sponge, cotton, wool, wicking synthetic fibers such as polypropylene, and the like.

In one embodiment, the inner layer may be formed as a sheet comprising absorbent and/or disinfecting materials. In a further embodiment, an interior region within the inner layer may enclose and contain the absorbent and/or disinfecting materials. Moisture from the moist garments may pass through the inner layer and be retained and/or disinfected by the materials contained by the interior region. In a further embodiment, the inner layer may comprise a deodorizing agent and/or a fragrance.

In another embodiment, the inner layer may form a pocket or pockets between the inner layer and outer layer. In these embodiments, a removable absorption layer may be inserted within the pocket to absorb moisture. In this embodiment, the absorption layer may contain moisture absorbing, disinfecting, deodorizing or fragranced materials. In operation, moisture from the moist garments may pass through the inner layer and be retained by the absorption layer. The passing of moisture is aided by compression of the garment during rolling. The absorption layer may be removed from the pocket for disposal, washing, drying and/or re-use.

In embodiments, the absorption layer may comprise a mesh, or other porous and/or water permeable outer surface that forms a pouch. Within the pouch may be a quantity of materials, as noted above to absorb moisture, disinfect, deodorize and/or provide fragrance, or any combination thereof.

In another embodiment, the inner layer may comprise one or a plurality of pockets as an interior region of the inner layer. The pockets may be sized and configured to allow the removable absorption layer to be stored directly within the inner layer.

In further embodiments, the inner layer may be formed as a plurality of sheets. In one embodiment, these sheets may go on a top and bottom of the moist garment. In another embodiment, the sheets may be sandwiched between multiple garments. In yet another embodiment, the outer layer may have inner layer sheets attached to a first side and an opposing second side, such that the sheets may absorb moisture on both sides of the garment when rolled.

In another embodiment, a plurality of sheets of an inner layer may be attached to the outer layer at one edge of the outer layer. In this embodiment, proximal ends of the plurality of sheets are attached to the outer layer, while distal ends are free. In varying embodiments, the inner layer sheets may be removably attached to the outer layer, or permanently attached. In operation, a moist garment may be positioned between two of the sheets, and the device may then be rolled allowing the inner layer sheets utilizing contact and compression of the garment to absorb moisture from both sides of the garment.

The device contemplated herein is intended to be rolled over moist clothing, as such, to hold it in a rolled position, the device further comprises a closure. The closure may be any structure that allows the device to be secured in a rolled position against forces such as an outward force by the garment and natural shape of the inner and outer layers.

Examples of closures contemplated herein may include, but are not limited to clasps, straps, elastics, pre-tensioned bands urging the layers to a rolled position, Velcro®, adhesive, snap buttons, end cap or caps, and the like.

Further, the device may comprise an enclosure to store the rolled device and garments stored therein. In one embodiment, the enclosure may be a bag. The bag may be air and/or water permeable to allow ventilation of the moisture within the device, or may seal the device from the exterior environment. In another embodiment, the enclosure may be one or a plurality of caps utilized to enclose open ends of the device when rolled.

In one embodiment, the device may further have a carrying strap or handle attached to an exterior of the outer layer. The strap may be permanently or removably attached.

The device may receive and roll about any type of garments and other wet items to store and/or dry them. Moist garments contemplated herein may include, but are not limited to clothing generally, bathing suits, towels, exercise clothing, umbrellas, hand washed and not yet dry garments, and the like. In many embodiments multiple garments may be rolled and stored in a single device.

The present invention may be used any number of ways to store and absorb moisture from one or a plurality of moist garments.

In one embodiment, a wet garment may be wrung to eliminate any excess water or fluid from the garment. The garment may then be placed flatly on an inner layer of the device. Optionally, a sheet of the inner layer may be placed on a top of the garment. Further optionally, removable absorption layers may be inserted into pockets or over the inner layer of the device. The device may then be rolled repeatedly over itself in a similar manner to how a rug is rolled up. Once rolled, the device may be secured in a rolled position by a closure.

Preferably, the device may be rolled fairly tightly, thereby squeezing excess fluid out of the garment. Once rolled, the device may be secured in the rolled position. During this rolling and storage, moisture transfers from the garment to the inner layer, and optionally from the inner layer to an absorption layer. Once moisture is transferred from the garment, it may be deodorized, disinfected, and/or stored, away from the garment.

After a period of time, the garment may be removed in a more dry state than it was initially. In embodiments wherein the inner layer and absorption layers are removable, they may then be removed for disposal or re-use. In embodiments having the inner layer permanently attached, the entire device may be dried, washed, and/or disposed of.

Turning now to FIG. 1 the drying device is shown in an unrolled position. An outer layer 10 is shown being slightly larger than an inner layer 11. The inner layer 11 is above the outer layer 10 when unrolled and the inner layer 11 is facing up. The inner layer 11 is attached along an edge of its proximal end 12 to the outer layer 10. The attachment at the proximal end 12 is shown here as a stitching. A garment 13 is laid out flat on the inner layer 11. While it is preferred that the garment be laid flat, it is not necessary for operation of the drying device. A strap 14 is attached to a distal end of the outer layer 10. The strap 14 may be used to secure the device in a rolled position when rolled.

Figure 2:
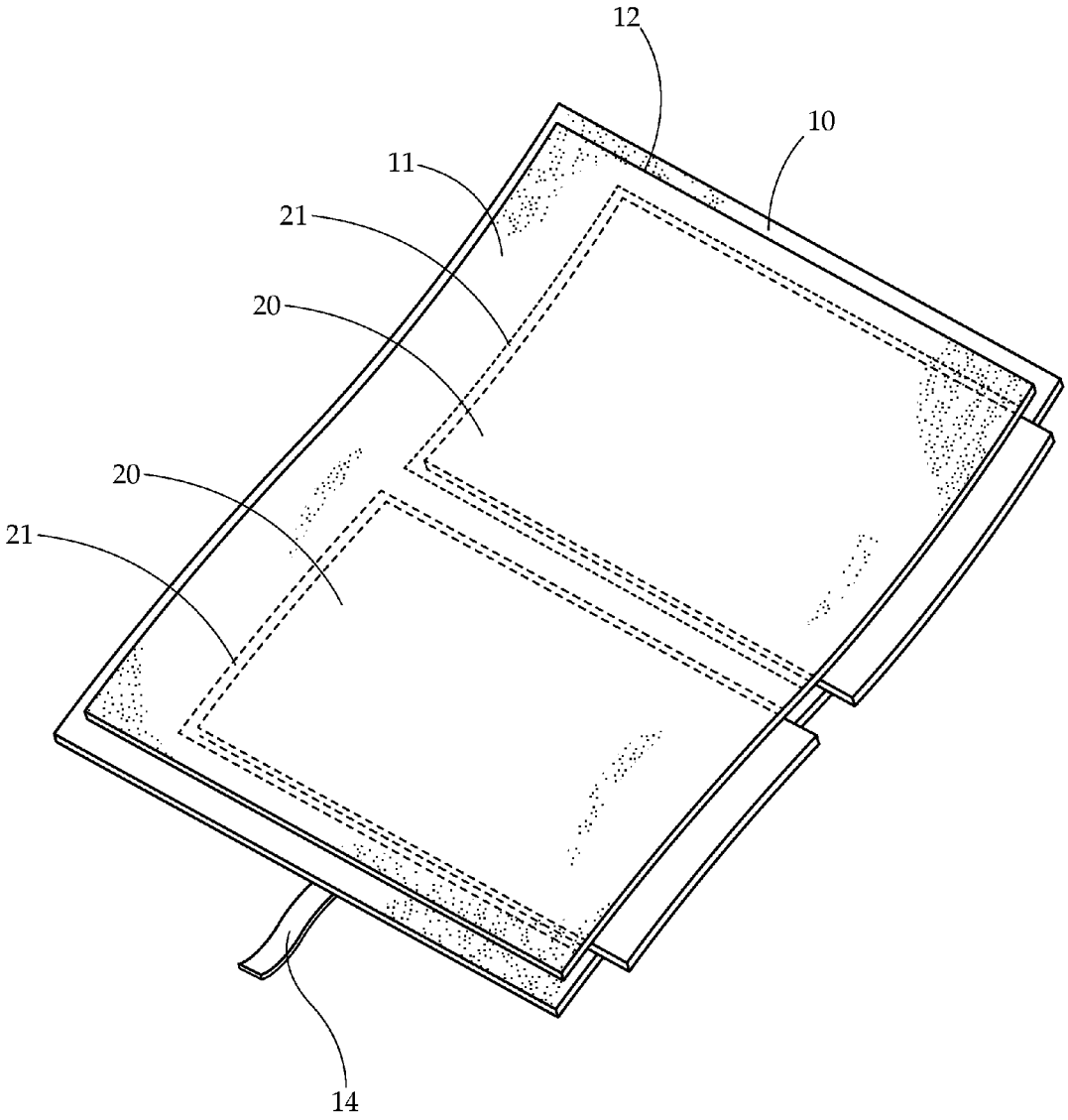
FIG. 2 provides an embodiment of the drying device.

FIG. 2 shows another embodiment of the drying device. In this embodiment, the inner layer 11 is attached to the outer layer 10 at attachment point 12. The inner layer 11 is configured with pockets 21 having at least one open end. In the pockets 21 are absorption layers 20. The absorption layers are removable layers that provide additional absorption capacity to the device. As noted above, absorption layers may be comprised of various materials designed to absorb moisture. In addition, the absorption layers may comprise disinfecting, deodorizing, and/or fragranced materials to add to the efficacy of the drying device. A strap 14 is attached to a distal end of the outer layer 10. The strap 14 is used to secure the device in a rolled position when rolled.

Figure 3:
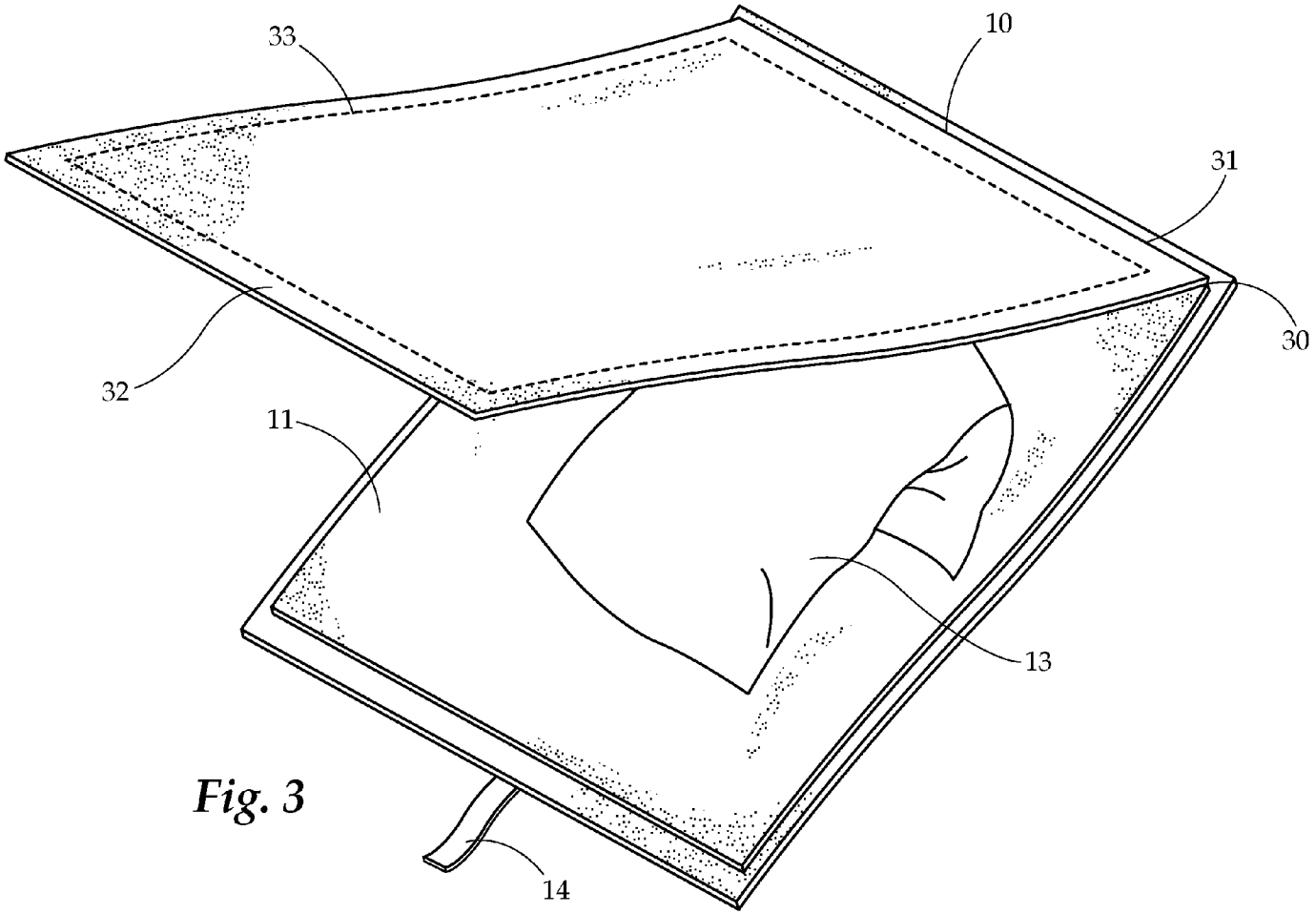
FIG. 3 provides yet another embodiment of the drying device in an unrolled position.

FIG. 3 provides yet another embodiment of the drying device in an unrolled position. The inner layer 11 is attached to the outer layer 10 at a proximal end using a Velcro® system 30, 31, thereby allowing the inner layer 11 to be removably attached to the outer layer 10. The inner layer 11 further comprises a top sheet 32 which may be laid over a top of a garment 13 placed on the inner layer 11. Within the top sheet is an absorption layer 33 which may or may not be removable, and which is configured to provide additional absorption. A strap 14 is attached to a distal end of the outer layer 10. The strap 14 is used to secure the device in a rolled position when rolled.

Figure 4:
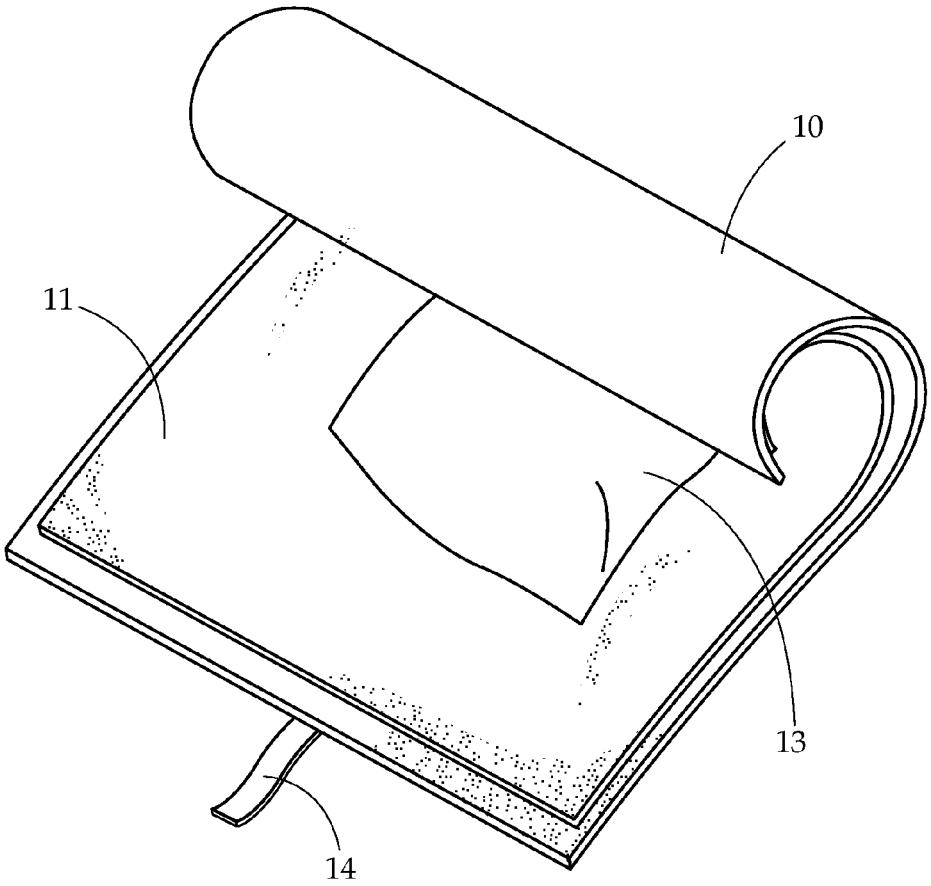
FIG. 4 provides a view of an embodiment of the drying device in a partially rolled position.

FIG. 4 provides an embodiment of the drying device in a partially rolled position. The inner layer 11 can be seen attached above the outer layer 10. As the device is being rolled, the garment 13 is urged in between the inner layer 11 and an outside of the outer layer 10, thus urging moisture from the garment 13 to the inner layer 11. A strap 14 is attached to a distal end of the outer layer 10. The strap 14 is used to secure the device in a rolled position when rolled.

Figure 5:
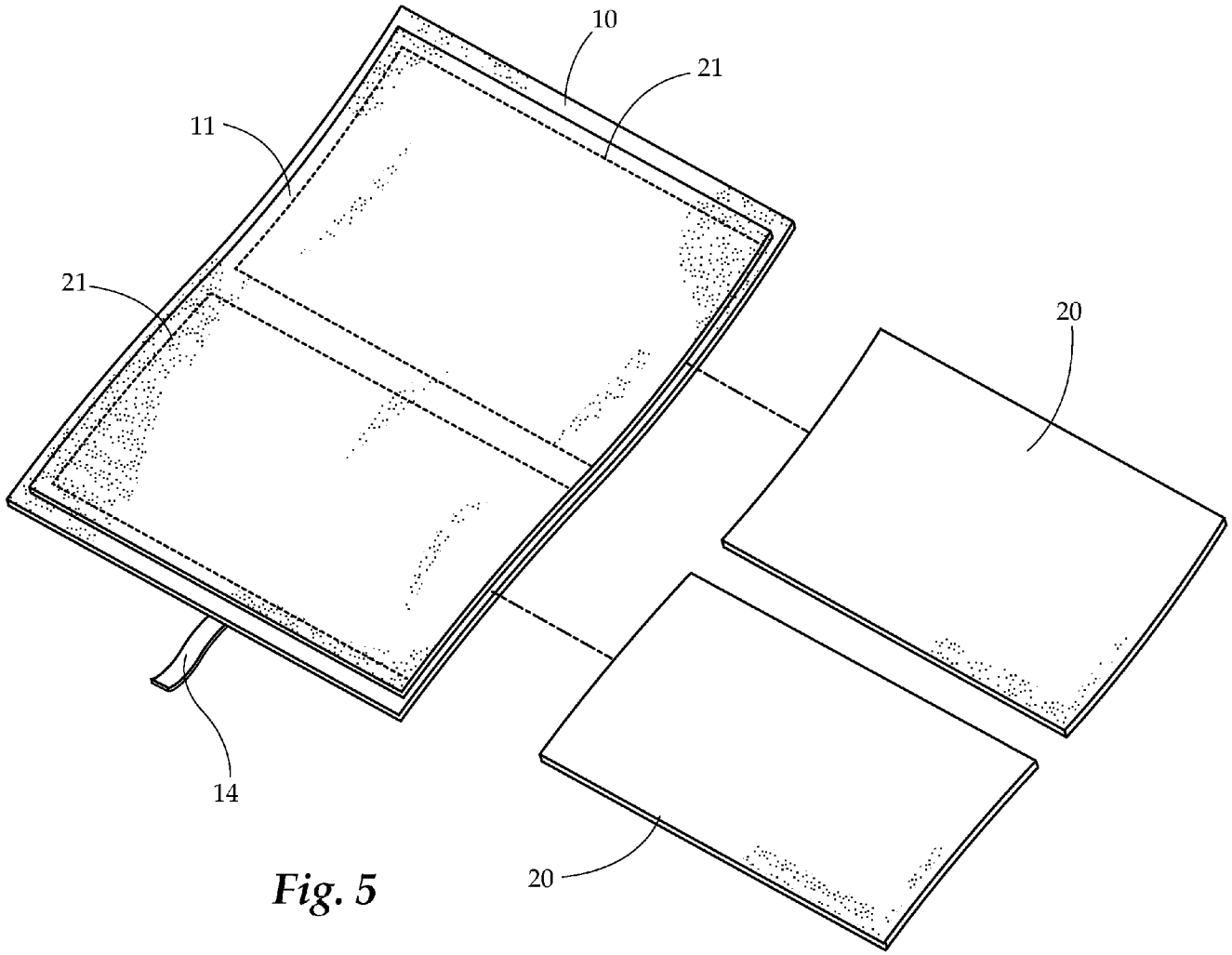
FIG. 5 provides a view of an embodiment of the drying device showing an absorption layer removed.

FIG. 5 provides a view of an embodiment of the drying device unrolled and having an absorption layer removed. In this view, the inner layer 11 is attached to the outer layer 10 at attachment point 12. The inner layer 11 is configured with pockets 21 having at least one open end. In the pockets 21 are absorption layers 20, with one absorption layer 20 being removed. The absorption layers are removable layers that provide additional absorption capacity to the device. As noted above, absorption layers may be comprised of various materials designed to absorb moisture. In addition, the absorption layers may comprise disinfecting, deodorizing, and/or fragranced materials to add to the efficacy of the drying device. A strap 14 is attached to a distal end of the outer layer 10. The strap 14 is used to secure the device in a rolled position when rolled.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A garment drying device comprising:

an outer layer, the outer layer being substantially planar and having an inner surface and an outer surface, the outer layer being formed of a substantially flexible material;

an inner layer attached to the inner surface of the outer layer, the inner layer being substantially planar and formed of an absorbent and flexible material, the inner layer having a substantially similar shape to the outer layer;

a closure structure, the closure having a closed position and an open position; and wherein the device is in a rolled position when the closure is in a closed position, wherein a moist garment positioned in the device in the rolled position transfers moisture to the absorbent inner layer by a compression of the garment between the outer layer and inner layer, and wherein the device is in an unrolled position when the closure is in an open position.

2. The garment drying device of claim 1 further comprising a moist garment positioned on a top surface of the inner layer, the moist garment compressed between the outer layer and inner layer when in the rolled position.

3. The garment drying device of claim 1 wherein the inner layer is removably attached to the outer layer.

4. The garment drying device of claim 1 wherein the inner layer is smaller than the outer layer.

5. The garment drying device of claim 1 wherein the inner layer forms a pocket.

6. The garment drying device of claim 5 further comprising an absorption layer removably positioned within the pocket of the inner layer.

7. The garment drying device of claim 6 wherein the absorption layer further comprises a water absorbing powder.

8. The garment drying device of claim 6 wherein the absorption layer further comprises a deodorizing material.

9. The garment drying device of claim 1 wherein the inner layer further comprising a water absorbing powder.

10. The garment drying device of claim 1 wherein the inner layer further comprises a deodorizing material.

11. The garment drying device of claim 1 wherein the inner layer is attached to the outer layer by an attachment along an edge of an end of the inner layer.

12. The garment drying device of claim 1 wherein the inner layer comprises a plurality of sheets, each of the plurality of sheets attached to the outer layer at one end of each of the sheets.

13. The garment drying device of claim 1 wherein a moist garment is positioned between one of the plurality of sheets and another of the plurality of sheets.

14. A method of drying and storing a moist garment using a drying device comprising the steps of:

placing a moist garment on an absorbent, flexible inner layer of a drying device, the drying device having a flexible outer layer attached to the inner layer, the inner layer and outer layer being similar in shape, with the drying device being capable of a flat unrolled position and a rolled position, the drying device having a closure capable of retaining the device in a rolled position;

urging moisture from the moist garment into the inner layer by rolling the drying device over itself into the rolled position, wherein the rolled position forms the device into a cylindrical shape, and wherein the urging of the moisture into the inner layer is performed by a compression of the garment between the outer layer and inner layer;

securing the drying device in the rolled position using the closure; and storing the drying device with the garment within it in a rolled position for a period sufficient to allow a substantial quantity of moisture to be transferred from the garment to the inner layer.

15. The method of drying and storing a moist garment using a drying device of claim 14 further comprising the steps of:

unsecuring the drying device using the closure;

unrolling the device; and removing the garment, the garment containing substantially less moisture than when initially placed on the inner layer.

16. The method of drying and storing a moist garment using a drying device of claim 14 further comprising inserting an absorption layer into a pocket of the inner layer.

17. The method of drying and storing a moist garment using a drying device of claim 14 further comprising the step of removing the inner layer from the outer layer, and cleaning the removed inner layer.

18. The method of drying and storing a moist garment using a drying device of claim 14 further comprising the step of removing the inner layer from the outer layer and disposing of the removed inner layer.

19. The method of drying and storing a moist garment using a drying device of claim 14 further comprising the step of placing the moist garment between a first sheet of the inner layer and a second sheet of the inner layer.

20. A garment drying device comprising:

an outer layer, the outer layer being substantially planar and having an inner surface and an outer surface, the outer layer being formed of a substantially flexible material;

an inner layer comprising a plurality of sheets removably attached to the inner surface of the outer layer, the inner layer plurality of sheets being substantially planar and formed of an absorbent and flexible material and a flexible material, the inner layer plurality of sheets each having a substantially similar shape to the outer layer and being slightly smaller than the inner layer;

a cavity formed by at least one of the plurality of sheets of the inner layer, the pocket containing a quantity of deodorizing material;

a closure structure, the closure having a closed position and an open position;

wherein the device is in a rolled position when the closure is in a closed position, and wherein the device is in an unrolled position when the closure is in an open position; and a garment positioned on a top surface of the inner layer.

* * * * *